US005231743A

United States Patent [19]

Goldstein

[11] Patent Number: 5,231,743

[45] Date of Patent: Aug. 3, 1993

[54] YARN TEXTURING JET WITH AUTOMATIC STRING-UP

[75] Inventor: Arnold S. Goldstein, Wilmington, Del.

[73] Assignee: E. I. Du Pont de Nemours and Company, Wilmington, Del.

[21] Appl. No.: 922,657

[22] Filed: Jul. 31, 1992

[51] Int. Cl.[5] ..... D02G 1/16

[52] U.S. Cl. ..... 28/272; 28/254; 28/273

[58] Field of Search ..... 28/254, 255, 271, 272, 28/273, 274, 275, 276

[56] References Cited

U.S. PATENT DOCUMENTS

| | | | |
|---|---|---|---|
| 3,577,614 | 5/1971 | Price | 28/254 |
| 4,259,768 | 4/1981 | Clendening et al. | 28/254 |
| 4,282.637 | 8/1981 | Mosseri et al. | 28/254 |
| 4,492,009 | 1/1985 | Agers et al. | 28/254 |
| 4,547,938 | 10/1985 | Cullen, Jr. | 28/254 |
| 4,574,436 | 3/1986 | Cullen, Jr. | 28/254 |
| 5,140,729 | 8/1992 | Simmen | 28/254 X |

FOREIGN PATENT DOCUMENTS

| | | | |
|---|---|---|---|
| WO91/03586 | 1/1991 | PCT Int'l Appl. | 28/254 |

*Primary Examiner*—Clifford D. Crowder
*Assistant Examiner*—Larry D. Worrell

[57] ABSTRACT

A self-stringing jet device which is compact, easy to disassemble, and easy to string up includes a body, a yarn inlet section, and a movable venturi located at the outlet end of the jet. The venturi may be moved from a string up position to an operating position by engaging the movable venturi located within the jet with a tapered pin that matches a v-shaped groove in the venturi to act as a cam to move the venturi to the string-up position.

4 Claims, 2 Drawing Sheets

YARN TEXTURING JET WITH AUTOMATIC STRING-UP

BACKGROUND OF THE INVENTION

The invention relates to air texturing of yarn and, more particularly, to improvements in a fluid jet apparatus used to texture the yarn.

U.S. Pat. No. 4,574,436 discloses a self-stringing jet device which is compact and easy to string up. The jet includes a body, a yarn inlet section, a movable venturi and a cylindrical baffle located at the outlet end of the jet. The venturi may be set to a string up position or to an operating position by means of a flat-sided rod and a ball stop engaging a groove in a collar on the venturi. In this embodiment, the rod is rotated to the string-up position and then rotated to an operating position following string up.

SUMMARY OF THE INVENTION

A yarn texturing jet has now been found which is easy to disassemble, can be threaded up without external aids, and automatically returns to the operating position after string-up. This jet device includes a hollow body member forming a fluid chamber, means for introducing fluid under pressure into the chamber, a freely moveable exit nozzle adjacent the chamber for passing fluid and yarn, a yarn guiding element extending through the body chamber for supplying yarn to the nozzle for texturing wherein the improvement comprises providing the nozzle with a circumferential v-shaped groove and mounting the nozzle on the body for movement from an operating position to a string-up position closer to the end of the yarn guiding element and for movement back to the operating position. The yarn guiding element is held in place by a bayonet catch and spring element for ease of disassembly and reassembly for cleaning and maintenance.

Means are provided for stopping movement of the nozzle member at a preset operating position and a pin is mounted on the body for movement toward and away from the v-shaped groove. The pin and the v-shaped groove have matching facing tapers, the taper of said pin being eccentric with said v-shaped groove whereby when said pin moves into engagement with said groove, the exit nozzle is moved toward said yarn guiding element in string-up position. Spring means are provided to disengage the pin from said groove and allow said nozzle to automatically return to the preset operating position by means of fluid pressure.

BRIEF DESCRIPTION OF THE DRAWINGS

Figure 1:
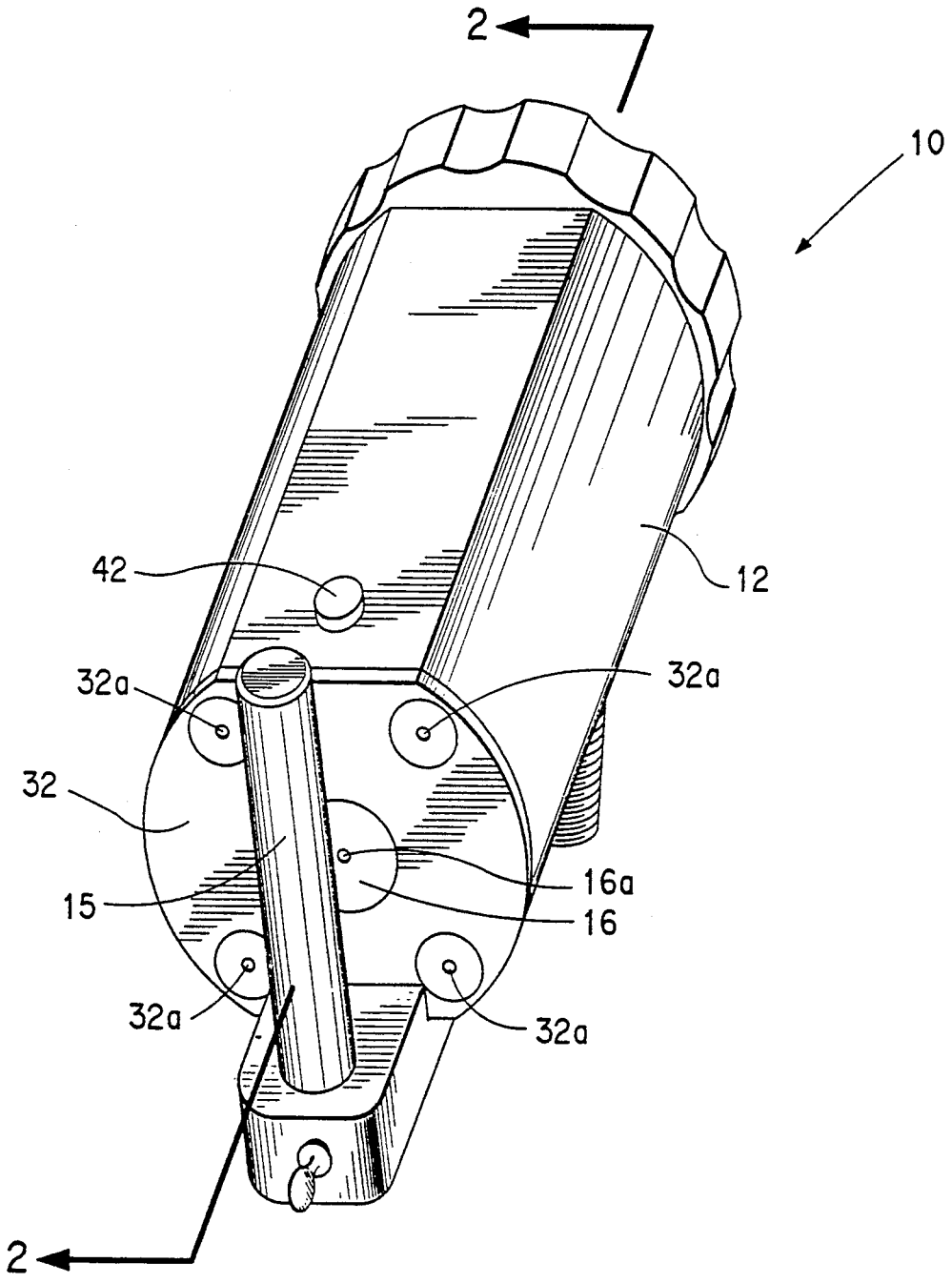
FIG. 1 is a perspective view of a preferred embodiment of the invention.

Referring to the drawing, the major elements of the jet 10 are hollow body member 12, yarn guiding element 14 and exit nozzle 16 and baffle bar 15 mounted to body member 12.

Figure 2:
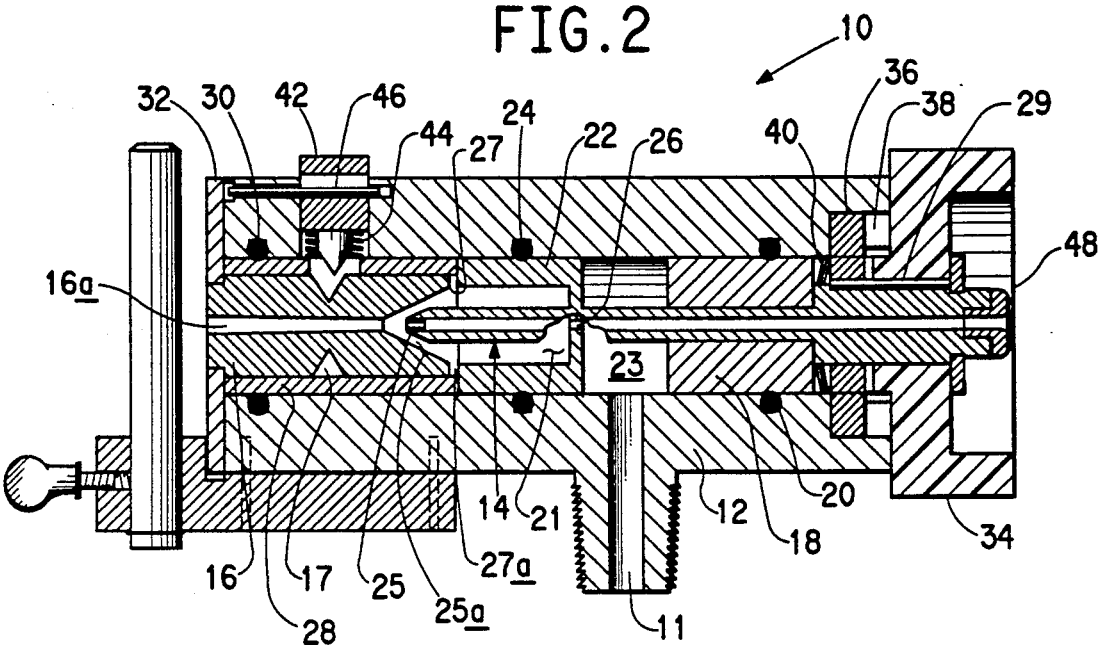
FIG. 2 is a section view of FIG. 1 taken along line 2—2 showing the jet in operating position.

The initial portion 18 of the yarn guiding tube 14 is enlarged to fit snugly inside the body member against "O" ring 20 while a latter portion is enlarged as a cup 22 to fit snugly inside the body member against "O" ring 24 to form annular chamber 23 and annular chamber 21. Cup 22 has a hole 26 through its bottom, thereby connecting chambers 21 and 23. Adjacent conical end 25 of the yarn guiding tube 14 is a funnel shaped entrance end 27 of nozzle 16 which is mounted for movement in sleeve 28 which fits snugly inside the body member against "O" ring 30 and is located by end plate 32 fastened to the body by screws 32*a*. The nozzle 16 has a circumferential v-shaped groove 17. The annular chamber 23 is supplied with pressurized fluid through passage 11. The fluid passes into chamber 23, then through hole 26 and into chamber 21 in cup 22 and through nozzle passage 16*a*. When fitted in the body 12, yarn guiding tube 14 contacts sleeve 28 at cup 22. A handle 34 and bayonet catch 36 are rotationally keyed by pin 29 to the yarn guiding element 14. Rotation of handle rotates the yarn guiding tube and catch to engage the bayonet catch 36 with bayonet groove 38. As bayonet catch engages the groove 38, it is moved toward the nozzle 16 by angled surfaces (not shown) on the groove so that spring 40 is depressed by bayonet catch 36, thereby urging yarn guiding element 14 forward until cup 22 is pressed against sleeve 28. The urging force developed by spring 40 is greater than the force of the pressurized fluid in cup chamber 21. The pressurized fluid in cup chamber 21 urges nozzle 16 against plate 32. A pin 42 is mounted on the body 12 for movement toward and away from v-shaped groove 17. The pin 42 and the v-shaped groove 17 have matching facing tapers and, as shown in FIG. 2, the pin 42 is located eccentric with the groove and the pin 42 is biased against the body by spring 44 and held within the body by pin 46. The small, low profile of the pin 42 beyond the body 12 reduces the possibility of random yarn snagging and trapping found in other devices with protruding elements associated with their threading devices.

Figure 3:
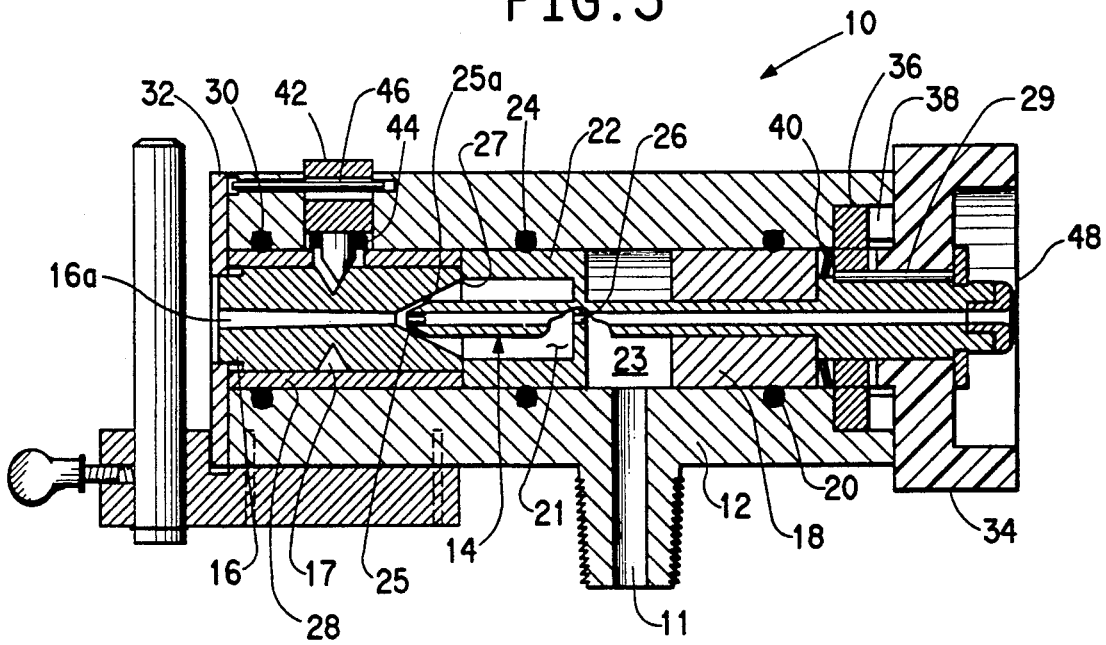
FIG. 3 is a section view of FIG. 1 taken along line 2—2 showing the jet in string-up position.

To move the nozzle 16 for string-up, the pressure through passage 11 into the cup chamber 21 is reduced and pin 42 is depressed against spring 44 until the tapered end of pin 42 engages fully in groove 17 on nozzle 16. This engagement forces the tunnel-shaped entrance end 27 of nozzle 16 toward the conical end 25 of yarn guiding tube 14 and reduces the gap therebetween (FIG. 3) until end surface 27*a* is pressed against cup 22. In this position, flow of fluid through the gap 25*a* creates a suction in yarn tube 14 to draw yarn through the yarn guiding tube from entrance 48 toward passage 16*a*. When pin 42 is released, spring 44 automatically removes the pin from the groove 17 so that the nozzle can automatically return to the operating position shown in FIG. 2 against plate 32 by means of fluid pressure from cup chamber 21 acting on funnel-shaped entrance end 27 of nozzle 16.

The easy disassembly of the jet 10 is accomplished by twisting the handle 34 to disengage the bayonet catch 36 from the groove 38. The handle and attached needle can then be pulled from the hollow body 12 and the body tilted so the nozzle 16 can be freely slid from the sleeve 28 and body 12. The needle and nozzle can then be easily cleaned and reassembled in the body by reversing the above steps. No tools are required for this disassembly and reassembly of the needle and nozzle in the body. No special adjustment is required to align the needle and nozzle for operation after reassembly.

Fine changes in the gap 25*a* between the funnel-shaped surface of the nozzle 16 and the conical surface of end 25 on guiding element 14 can be easily made by changing the length of sleeve 28 which controls the operating position of guiding element 14. The length of nozzle 16 could also be changed to make changes in the gap 25*a*, but the nozzle is a more expensive element in the assembly. To change out the sleeve, baffle bar 15 and plate 32 are removed, pins 46 and 42 are removed, and spring 44 is removed. The sleeve can then be extracted from body 12 and replaced with a sleeve of a slightly different length. Such changes may be useful for setting up the jet 10 for different products, speeds, or pressures while maintaining the precision and repeatability of the setup.

What is claimed is:

1. In a yarn texturing jet including a hollow body member forming a chamber, means for introducing fluid under pressure into the chamber, a freely movable exit nozzle adjacent the chamber for passing fluid and yarn, a yarn guiding tube having a conical end extending into the chamber for supplying yarn to the nozzle for texturing, the improvement comprising: said nozzle having a circumferential opened v-shaped groove and being slideably mounted in the hollow body member for movement from a preset operating position to a stringup position, closer to the conical end of the yarn guiding tube, and for movement back to the preset operating position; means for stopping movement of the nozzle member at the preset operating position; a pin mounted in said body for movement toward and away from said v-shaped groove, said pin having a tapered end facing said groove; said tapered end of said tapered pin said matching v-shaped groove, the taper of said pin being eccentric with said v-shaped groove whereby when said pin moves toward said groove, the tapered end of said pin contacts the taper of said groove and the exit nozzle is moved toward said yarn guiding tube into the stringup position; and spring means to disengage said pin from said groove and allow said nozzle to return to the preset operating position by means of the fluid pressure.

2. The jet as defined in claim 1 including a bayonet groove in the hollow body member, and an axially moveable bayonet catch attached to the year guiding tube for engaging the bayonet groove in the hollow body member, and spring means between the bayonet catch and the yarn guiding tube to press the tube axially against the hollow body member with an opposing force to the fluid pressure in the chamber, whereby as the bayonet catch moves axially the catch engages the bayonet groove.

3. The jet as defined in claim 2 including a handle rotationally keyed, to both the yearn guiding tube and bayonet catch, for rotating the tube and said catch to engage said catch with the bayonet groove and for axially and rotationally positioning said tube in the body member.

4. The jet as defined in claim 1 including a sleeve within the hollow body member for slideably containing the exit nozzle, and wherein the means for stopping movement of the nozzle is an end plate removably attached to the body member; said end plate also hold the sleeve in the body member against the fluid pressure in the chamber.

* * * * *